US005735208A

United States Patent [19]

Hummel et al.

[11] Patent Number: 5,735,208

[45] Date of Patent: Apr. 7, 1998

[54] APPLICATOR FOR A PRINTING MACHINE

[75] Inventors: Peter Hummel, Offenbach; Robert Ortner, Alzenau, both of Germany

[73] Assignee: MAN Roland Druckmaschinen AG, Germany

[21] Appl. No.: 818,706

[22] Filed: May 19, 1997

[30] Foreign Application Priority Data

Mar. 14, 1996 [DE] Germany ..... 196 09 946.3

[51] Int. Cl.[6] ..... B41F 5/00

[52] U.S. Cl. ..... 101/329; 101/357.1; 101/348

[58] Field of Search ..... 101/315, 321, 101/326, 329, 330, 331, 348, 357.1

[56] References Cited

U.S. PATENT DOCUMENTS

| | | | |
|---|---|---|---|
| 469,668 | 2/1892 | Bennett | 101/330 |
| 729,002 | 5/1903 | Spalckhaver . | |
| 829,230 | 8/1906 | Pope | 101/329 |
| 4,817,526 | 4/1989 | Winston | 101/329 |
| 5,353,700 | 10/1994 | Privin | 101/329 |

FOREIGN PATENT DOCUMENTS

| | | | |
|---|---|---|---|
| 953798 | 12/1949 | France | 101/331 |
| 23 050 | 4/1962 | German Dem. Rep. . | |
| 512490 | 8/1924 | Germany | 101/329 |
| 22 10 629 | 9/1973 | Germany . | |
| 137781 | 1/1930 | Switzerland | 101/329 |

*Primary Examiner*—Eugene H. Eickholt
*Attorney, Agent, or Firm*—Leydig, Voit & Mayer, Ltd.

[57] ABSTRACT

An assembly for the metered application of a liquid or pasty medium, to a driven printing cylinder includes a container which is fillable with the medium which provides an outlet opening facing the cylinder. A metering roller is rotatably mounted in the outlet opening and has a portion which protrudes from the outlet opening and can be pressed against the driven cylinder. A metering gap formed between the outer surface of the metering roller and a boundary surface of the outlet opening is adjustable.

19 Claims, 3 Drawing Sheets

APPLICATOR FOR A PRINTING MACHINE

FIELD OF THE INVENTION

The invention generally relates to the printing art, and more particularly, to an assembly for the metered application of a liquid or pasty medium, e.g., ink, varnish or the like, to a driven cylinder of a printing machine.

BACKGROUND OF THE INVENTION

Applicator devices of this general type are known in the art. Such devices comprise a container which is designed in the manner of an ink fountain. The container is inserted into an ink fountain for a main color, and is subdivided into a plurality of chambers. Each of the chambers provides an outlet opening that receives a metering roller. The metering rollers are arranged on a common shaft mounted in the container and are driven by an ink-fountain cylinder via a gear coupling. The ink supply is metered with the use of one or more adjusting mechanisms which are arranged on the bottoms of the respective chambers. The distance from the metering roller can be adjusted by means of adjusting screws and transmission levers.

Using this known applicator device, different printing inks can be applied in zones to the ink-fountain cylinder. This applicator device, however, has the disadvantage that its manufacture is complex. The adjusting mechanisms are arranged on the bottom of the chambers and are required to be sealed from the respective chamber walls. Furthermore, the metering rollers are arranged to the side of a container which is open at the top. This mounting arrangement restricts the possible application of this known device.

SUMMARY OF THE INVENTION

Accordingly, it is a general object of the invention to provide an applicator assembly that overcome the shortcomings of the prior art.

It is a more particular object of the invention to provide an applicator assembly which is simple to manufacture and handle.

It is another object of the invention to provide an applicator assembly which is suitable for applying different types of media, and which can be used in varying installation positions in an industrial printing machine.

These and other objects are achieved with an applicator assembly intended for use in conjunction with a printing cylinder. The assembly includes a metering roller freely rotatably mounted and can be driven by friction contact with the printing cylinder. The metering roller is at least partially housed in an ink container and defines a metering gap between the periphery of the metering roller and the container walls. An adjustment device is utilized to vary the relative position of the container with respect to metering roller. This action also adjusts the width of the metering gap.

The applicator assembly according to the invention is particularly advantageous for applications in which the axial width of the metering roller corresponds to the width of an independently controllable metering zone on the printing cylinder. If a medium is to be applied to a plurality of metering zones on the cylinder, a plurality of assemblies can be utilized.

DETAILED DESCRIPTION OF THE PREFERRED EMBODIMENTS

Generally, the invention is directed to an applicator assembly suited for use in conjunction with a printing cylinder in a printing machine. The applicator includes a metering roller that is partially exposed from the walls of a container housing filled with the fluid to be applied. The metering roller and container walls define a metering gap that is adjustable. The invention is particularly suitable for applying ink to cylinders of a printing machine, but it can also be used for applying varnish, adhesive or other liquid and paste-like media.

The illustrated applicator and metering assembly comprises an elongate, cube-shaped container 1 which is made from a thin-walled material, for example, sheet metal. The longitudinal axis of the container 1 is radially aligned with respect to an axis of rotation printing cylinder 2. The container is formed by a plurality of side walls denoted by the numerals 3, 4, 5, 6. One end of the container 1 is located remote from a printing cylinder 2 and is closed by a removable lid 7 which prevents the medium from drying.

Figure 1:
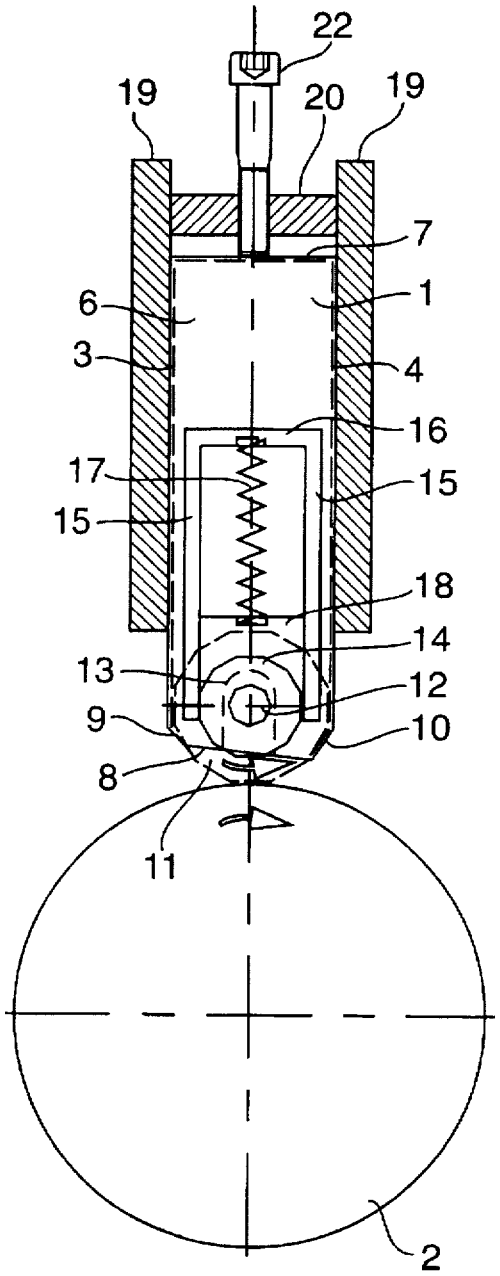
FIG. 1 shows a front view of an embodiment of an applicator and metering assembly according to the invention, viewed in the direction of an axis of rotation of a printing cylinder.
Figure 2:
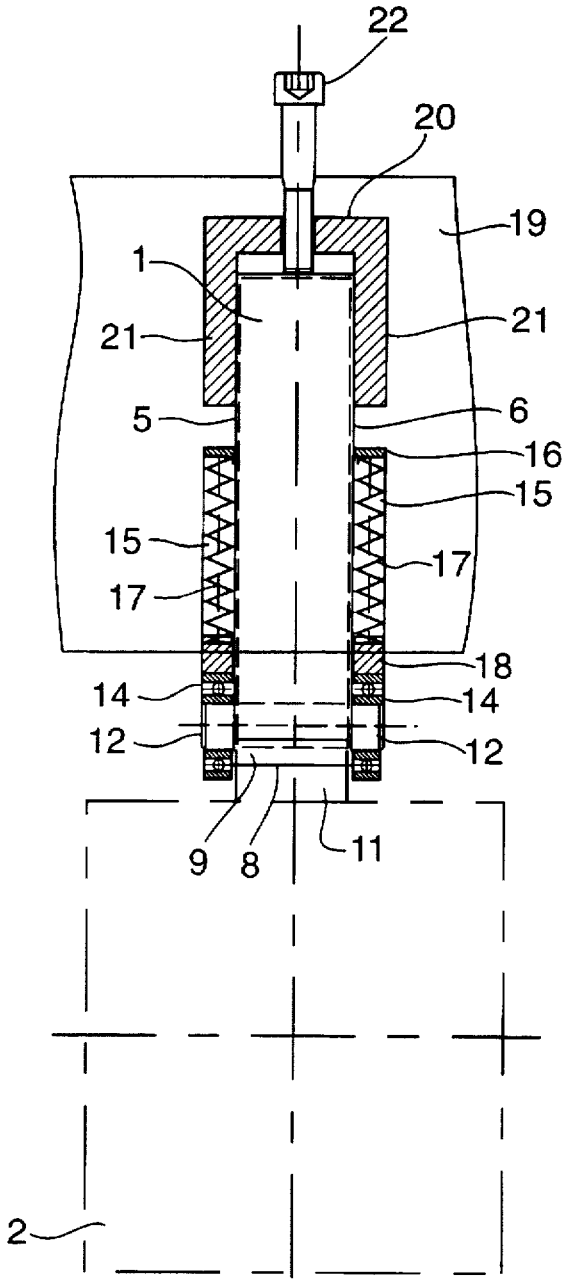
FIG. 2 shows a front view of the metering assembly according to FIG. 1, viewed perpendicular to the axis of rotation of the printing cylinder.
Figure 3:
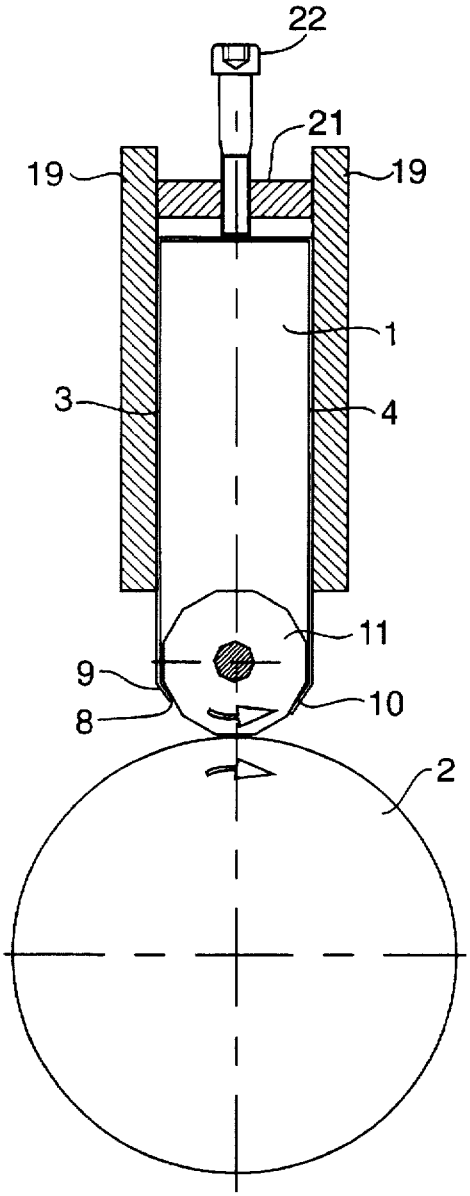
FIG. 3 shows a cross-section of the metering assembly according to FIG. 1 taken perpendicular to the axis of rotation of the printing cylinder.
Figure 4:
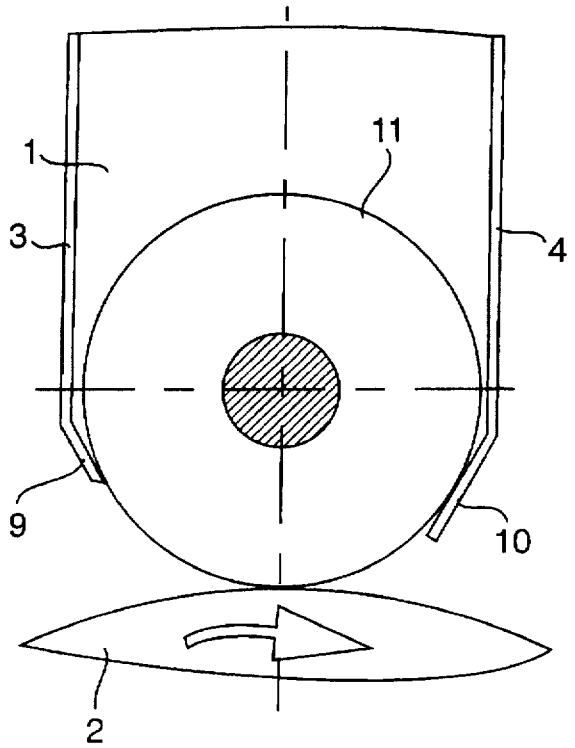
FIG. 4 shows an enlarged detail of the sectional view of FIG. 3 with a closed metering gap.
Figure 5:
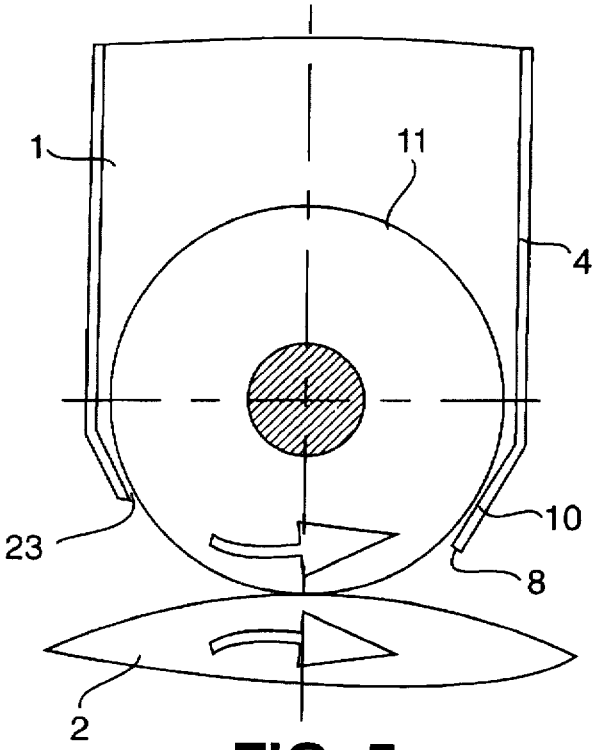
FIG. 5 shows an enlarged detail of the sectional view of FIG. 3 with an open metering gap.

The opposite end of the container 1 faces the printing cylinder 2. This end has an outlet opening 8 having a width, measured in the circumferential direction of the printing cylinder 2, that is smaller than the distance between the side walls 3, 4. This is achieved by mutually facing angled or bent wall portions 9, 10 in the ends of the side walls 3, 4. The bent wall portions 9, 10 provide wall surfaces that bound the outlet opening 8 as shown in FIGS. 3–5.

For implementing the invention, a metering roller is utilized having a greater diameter than the width of the outlet opening 8 and wherein the outlet opening 8 is adapted to the contour of the metering roller in such a way that it can be closed by the metering roller. This advantageously permits ready dismantling of the metering and applicator assembly without prior emptying. In addition the metering roller closes the outlet opening in the manner of a valve and prevents leakage from the container.

In the illustrated embodiment, a cylindrical metering roller 11 of a diameter less than the distance between the side walls 3, 4 and greater than the width of the outlet opening 8 is disposed in the container 1. The width of the metering roller 11 essentially corresponds to the distance between the side walls 5, 6 in the axial direction. The axis of rotation of the metering roller is located within the container, and the metering roller circumference projects slightly outwardly from the outlet opening 8. Thus, for a container 1 having a generally rectangular cross section, the width of the container interior, measured in the direction of the axis of rotation of the metering roller 11, generally corresponds to the length of the metering roller. The size of the container 1 is somewhat greater than the diameter of the metering roller 11.

The metering roller 11 includes first and second relatively flat end faces disposed to bear tightly against the inner sides of the container side walls 5, 6. The first and second metering roller end faces have bearing journals 12 which project outwardly from the container 1 through slots 13 formed in the side walls 3, 4. Roller bearings 14 are attached to the bearing journals 12. The bearings 14 include an outer ring guided within parallelly disposed guide rails 15 disposed on the container 1. In this way, the metering roller is journaled within the guides in such a manner to permit movement in a direction perpendicular to the axis of rotation of the metering roller.

For applying a force to press the metering roller against the cylinder, prestressed resilient means supported on the container cooperatively act on the metering roller bearings. Exemplary resilient means include compressing springs that are supported on the outer ring of the rolling bearings via a link block which is arranged between the guide rails of the respective straight guide.

In the illustrated embodiment, the guide rails 15 form a straight guide and are arranged on the outer side of the side walls 5, 6 symmetrically to the longitudinal center-plane of the container 1. The guide rail ends located remote from the outlet opening 8 are connected on each side of the container 1 by a web 16 which supports a compression spring 17. The compression spring 17 acts via a link block 18 located on the outer ring of the rolling bearing 14.

The container 1 is disposed between a pair of parallel, vertically extending strips 19. The container side walls 3, 4 are vertically displaceable and guided between the strips 19. The strips are connected by a U-shaped support member 20 which includes downwardly extending limbs 21 attached to the container 1 around its lid-side end. In cooperation with the side walls 5, 6, the limbs 21 form a further guide for the container 1. In this way, the container 1 is aligned with its longitudinal axis perpendicular to the axis of rotation of the printing cylinder 2.

For effecting relative movement of the container with respect to the printing cylinder, an adjusting device is provided to apply a force to the container. In the illustrated embodiment, an adjusting screw 22 is screwed into a threaded bore disposed in the bottom of the support 20. The container 1 can be adjusted in the longitudinal direction relative to the printing cylinder 2 by actuation of the adjusting screw 22. In this way, the frictional engagement of metering roller 11 bearing against the cylinder 2 is also adjusted.

FIGS. 4 and 5 show different positions of the container 1 which are set with the aid of the adjusting screw 22. In FIG. 4, the adjusting screw 22 is unscrewed to the extent that it only slightly or no longer impinges on the lid 7 of the container 1. The compression springs 17, supported on the metering roller 11 via the link blocks 18 and the rolling bearings 14, urge the container 1 in the direction of the adjusting screw 22 until the container bent portions 9, 10 bear against the outer surface of the metering roller 11.

In this position, the outlet opening 8 is closed by the metering roller 11. The forces applied by the prestressed compression springs 17 are absorbed by the bearing of the metering roller 11 against the bent portions 9, 10. The metering roller 11 is not driven by the printing cylinder 2 which continues to rotate in the direction of the arrow in FIG. 4, since the metering roller 11 is not pressed against the cylinder 2 by the compression springs 15. This position of the container 1 is expedient if there is to be no application of ink, varnish or the like to the printing cylinder 2 in the region of the metering roller 11.

In order to ensure avoidance of contact between the metering roller 11 and the cylinder 2 in this position, additional biasing means such as a tension spring attached to the support 2 and the container 1 may be provided. This ensures that the container 1 follows a resetting movement of the adjusting screw to the extent that the metering roller 11 is lifted up from the cylinder 2.

The container 1 may also be moved toward the printing cylinder 2 with the aid of the adjusting screw 22 until the metering roller 11 is supported solely on the cylinder 2 and is lifted away the bent portions 9, 10. Such a container position is shown in FIG. 5. In this case, the forces of the compression springs 17 are supported on the cylinder 2 via the metering roller 11 and on the adjusting screw 22 via the container 1. The transmission of forces between the metering roller 11 and the cylinder 2 ensures an adequate frictional engagement for the metering roller 11 to be set in rotation by the cylinder 2. In this case, the metering roller 11 is mounted to the container 1 via the rolling bearings 14. Rotation of the metering roller 11 carries the medium located in the container 1 along the outer peripheral surface of the metering roller 11. The medium is conveyed out of the container 1 through a metering gap 23, which is formed by the space between the shorter bent portion 9 and the outer surface of the metering roller 11. The medium is typically carried in the form of a thin film and, at the point of contact between the metering roller 11 and the printing cylinder 2, is transferred to the latter.

In the event that the metering roller does not entirely transfer the medium carried along on its surface to the surface of the cylinder, a further gap is provided between the boundary surface of the outlet opening opposite the metering gap and the peripheral surface of the metering roller. In this way, the medium not transferred to the printing cylinder is conducted back into the container. The boundary surface located opposite the metering gap is preferably extends outwardly beyond the line of the shortest distance from the outer surface of the metering roller in order to promote the return transport of the medium.

That is, any medium retained on the outer surface of the metering roller 11 after contact with the cylinder 2, this medium passes into the container 1 via the gap between the longer bent container portion 10 and the outer surface of the metering roller 11. The size of the metering gap 23 and thus the thickness of the film formed on the outer surface of the metering roller can be varied simply by setting the adjusting screw 22, in that the container 1 is moved relative to the cylinder 2. The adjusting screw 22 can be turned by hand or by means of an adjusting motor (not shown) by remote control.

In the example described above, only one metering and applicator assembly according to the invention was utilized. However, the applicator assembly described may also be used for applications in which ink is applied to the entire working width of a cylinder, e.g., in the inking unit of a printing machine, in zones with different metering. For this purpose, a plurality of containers 1 and corresponding supports are arranged with metering rollers 11 on a support member which extends over the entire width of the cylinder. Each of the supports comprises two strips arranged at regular intervals. The metering quantity of each metering roller is individually adjustable by means of an adjusting screw in the manner described above.

Figure 6:
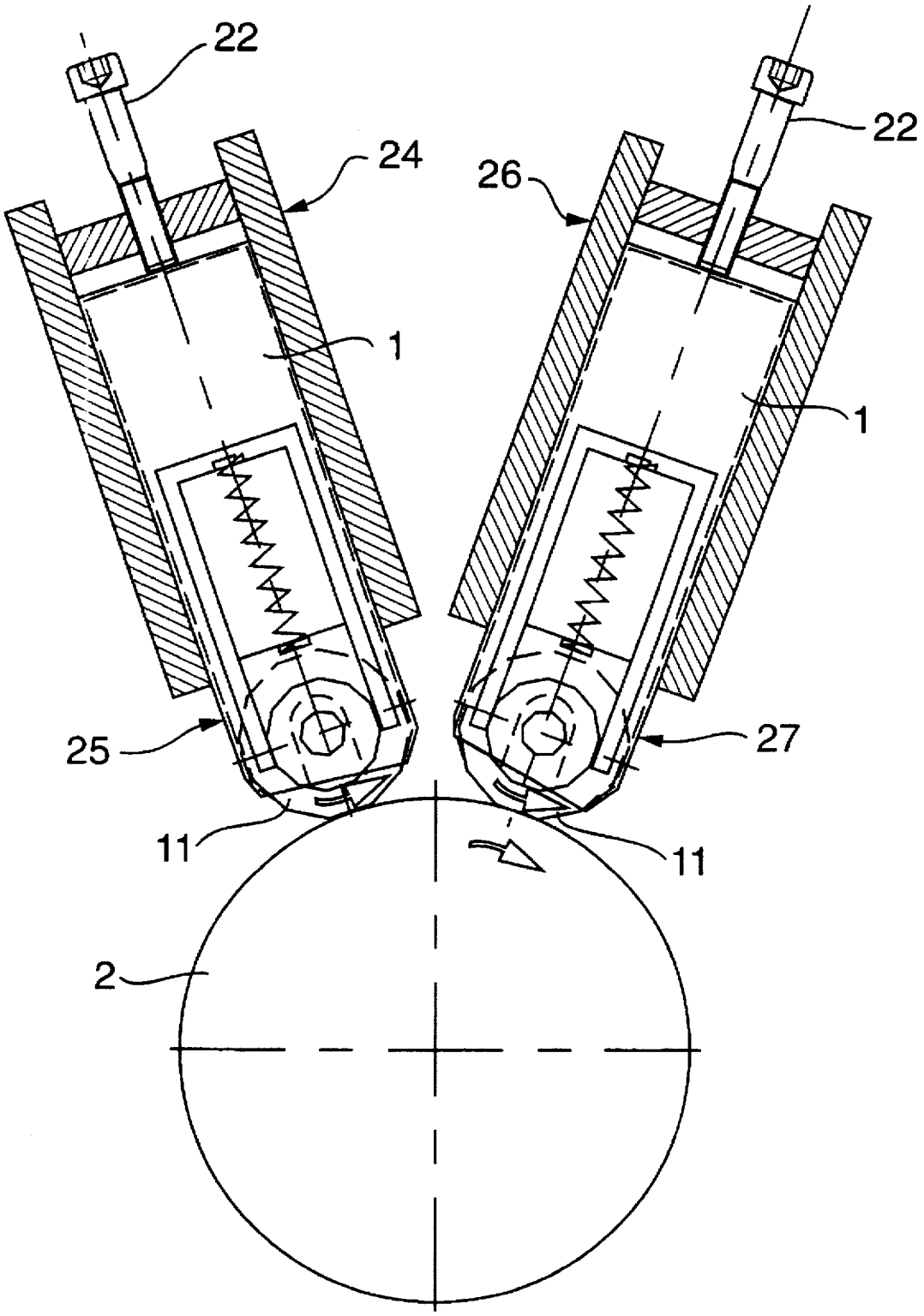
FIG. 6 shows a front view of an arrangement with a plurality of metering assemblies used in conjunction with a common printing cylinder.

In such an arrangement, a space in which there is no ink application inevitably remains between the individual metering rollers due to the bearings and compression springs arranged on both sides of the metering roller 11. If this is to be avoided, a second supporting member 26 and corresponding applicator assemblies 27 can be arranged on the cylinder 2 offset in the circumferential direction relative to a first supporting member 24 and assemblies 25, as is shown in FIG. 6. The respective metering rollers of the assemblies 27 are each located in the space between the metering rollers of the assemblies 25. This enables a continuous layer of a medium, for example, a printing ink, to be applied to the working surface of a cylinder. In this case, however, it is possible for each zone determined by the width of a metering roller to be varied both in respect of the application quantity and in respect of the medium.

The metering device described is equally suitable for applying ink to a duct cylinder, a distributor or an intermediate cylinder of an inking unit or even directly for the application of ink to a plate cylinder. The medium to be applied is metered in a simple manner by axial displacement of the container relative to the metering roller and by the change in the metering gap such action involves. This adjustment is accomplished manually or else by motor power with the aid of a central or decentralized control. Depending on requirements, a single metering assembly or a plurality of metering assemblies arranged adjacently and/or offset relative to one another can be used. It is possible for the metering assemblies to be exchanged in a simple manner both individually and as a complete module. Inasmuch as the metering containers automatically close as the assemblies are lifted up from the assigned cylinder, the setting of the individual metering gaps can remain unchanged when the metering assemblies are replaced or changed. When used in an inking unit, the metering assembly according to the invention also provides the possibility of using ink metering containers of different colors next to one another.

Depending on the application, the material pairing of the metering roller and the counter-cylinder can be matched by exchanging the metering roller. Suitable material pairings are steel on steel, steel on rubber, or rubber on steel, rubber on printing plate, ceramic on rubber, plastic on steel, plastic on plastic, plastic on printing plate, plastic on ceramic or plastic on rubber. The surface of the metering roller can be coated or structured in different ways.

Various advantages flow readily from the invention. For example, the invention is designed in a particularly simple manner. That is, the fillable container can be formed of rigid walls and does not require any internal adjusting mechanism, since any change in the size of the metering gap is accomplished by the displacement of the metering roller in the outlet opening. It is particularly advantageous that the metering gap is changed in this manner since the friction contact between the metering roller and the printing cylinder permits a change in position of the metering roller only in the circumferential direction of the printing cylinder.

It should be understood that the invention is susceptible to various modifications and alternative constructions and that only certain illustrated embodiments thereof have been shown and described above. It should also be understood, however, that there is no intention to limit the invention to the specific form disclosed, but on the contrary, the intention is to cover all modifications, alternative constructions and equivalents falling within the spirit and scope of the appended claims.

What is claimed is:

1. An assembly for the metered application of a fluid or the like to a driven cylinder of a printing machine comprising:

a least one container at least partially filled with the medium to be applied providing an outlet opening facing the cylinder defined by an opening boundary surface;

a rotatably mounted metering roller arranged at the outlet opening with at least a portion thereof which protrudes outwardly from the outlet opening disposed to be driven by friction contact with the cylinder, the opening boundary surface and the peripheral surface of the metering roller defining a metering gap which is adjustable in its width; and an adjustment device coupled with the container adapted to change the position of the metering roller relative to the container opening boundary surface and to thereby change the width of the metering gap.

2. The invention as in claim 1 wherein the adjustment device is adjusted with the use of a remotely controlled adjusting motor.

3. The invention as in claim 2 wherein the metering gap can be changed by adjusting the position of the container.

4. The invention as in claim 3 wherein the container is adjusted in a direction which is essentially radial relative to the axis of rotation of the printing cylinder.

5. The invention as in claim 2 wherein the diameter of the metering roller is greater than the width of the outlet opening in the container.

6. The invention as in claim 1 wherein the outlet opening can be closed by relative movement of the container and the metering roller.

7. The invention as in claim 6 wherein the container further comprises opposed parallel guides and wherein the metering roller includes a bearing adapted to be received within the guides being displaceable in a direction perpendicular to the axis of rotation of the metering roller.

8. The invention as in claim 7 wherein the metering roller includes an axle, and bearings disposed at both ends of the axle adapted to received between pairs of parallel guide rails.

9. The invention as in claim 8 further including prestressed resilient means supported on the container for applying a force to the metering roller bearing to press the metering roller against the printing cylinder.

10. The invention as in claim 9 wherein the resilient means is supported on the rolling bearings via a link block which is arranged between the guide rails of the respective opposed guides.

11. The invention as in claim 10 wherein the axis of rotation of the metering roller is disposed in the container interior with a relatively small portion of metering roller circumference projecting outwardly from the outlet opening.

12. The invention as in claim 11 wherein the container has a rectangular cross-section, and wherein the width of the container interior, measured in the direction of the axis of rotation of the metering roller, corresponds to the length of the metering roller.

13. The invention as in claim 12 wherein the dimension of the container interior perpendicular to the axis of rotation of the metering roller is greater than the diameter of the metering roller.

14. The invention as in claim 13 wherein a return gap is selectively provided between the boundary surface of the outlet opening opposite the metering gap and the peripheral surface of the metering roller, the return gap passing medium not transferred to the cylinder into the container.

15. The invention as in claim 14 wherein the container is mounted in a guide formed by two parallel plates.

16. The invention as in claim 15 further comprising a plurality of assemblies for metering fluid, each having a corresponding metering roller placed against the printing cylinder.

17. The invention as in claim 16 wherein adjacent ones of the plurality of assemblies are arranged offset in the circumferential direction of the printing cylinder.

18. The invention as in claim 16 wherein adjacent ones of the plurality of assemblies are arranged offset in the axial direction of the printing cylinder.

19. The invention as in claim 18 wherein adjacent ones of the plurality of assemblies are also offset in the circumferential direction of the printing cylinder.

* * * * *